US006264495B1

(12) United States Patent
Robertson et al.

(10) Patent No.: US 6,264,495 B1
(45) Date of Patent: Jul. 24, 2001

(54) ELECTRICAL COMPONENTS

(75) Inventors: James William Robertson; Harry Milton Capper, both of Harrisburg, PA (US); Robert Naas, Skaneateles, NY (US); Kurt Werner, Auburn, NY (US); Deborah Laun, Syracuse, NY (US); Howard Scott Ryan, Skaneateles, NY (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/454,931

(22) Filed: Dec. 3, 1999

Related U.S. Application Data

(60) Provisional application No. 60/118,252, filed on Feb. 2, 1999.

(51) Int. Cl.[7] ..... H01R 4/24
(52) U.S. Cl. ..... 439/409
(58) Field of Search ..... 439/417, 410, 439/409

(56) References Cited

U.S. PATENT DOCUMENTS

| | | | | |
|---|---|---|---|---|
| 4,684,195 | * | 8/1987 | Anderson et al. | 439/409 |
| 4,795,364 | * | 1/1989 | Frantum, Jr. et al. | 439/409 |
| 5,006,077 | | 4/1991 | Loose et al. | 439/409 |
| 5,195,907 | * | 3/1993 | Urban | 439/410 |
| 5,496,192 | | 3/1996 | Hower et al. | 439/409 |
| 5,667,402 | | 9/1997 | Denovich et al. | 439/409 |
| 5,681,182 | * | 10/1997 | Reichle | 439/417 |
| 5,685,743 | * | 11/1997 | Schmidt et al. | 439/417 |
| 5,947,761 | * | 9/1999 | Pepe | 439/409 |

OTHER PUBLICATIONS

Introduction to AMP Insulation Displacement Technique and Products (HB 5351 Rev B) pp. 1–30, AMP Incorporated, Harrisburg, PA, dated 1979.

* cited by examiner

*Primary Examiner*—Renee Luebke
*Assistant Examiner*—Briggitte R. Hammond

(57) ABSTRACT

An electrical component (10, 110, 210, 310) for electrically connecting insulated electrical conductors (56) thereto comprises a dielectric housing (12, 112, 212, 312) including a first housing section (20, 118, 218, 318) and a second housing section (22, 120, 220, 320), first and second electrical contact members (42, 44, 158, 160, 240, 242, 334, 336) disposed in the dielectric housing and having first contacts (**42*a*, 44*a*, 158*a*, 160*a*, 240*a*, 242*a*, 334*a*, 336*a*) extending into the second housing section and second contacts (42*b*, 44*b*, 158*b*, 160*b*, 240*b*, 242*b*, 334*b*, 336*b*) positioned within the first housing section, insulation-displacement contacts (42*a*, 44*a*, 158*a*, 160*a*, 248, 348) as part of the first contacts along which the insulated electrical conductors are positioned, and conductor-moving members (16, 18, 154, 156, 250, 346**) for engaging the insulated electrical conductors and moving them into the insulation-displacement contacts thereby forming electrical connections between the insulation-displacement contacts and the insulated electrical conductors.

13 Claims, 15 Drawing Sheets

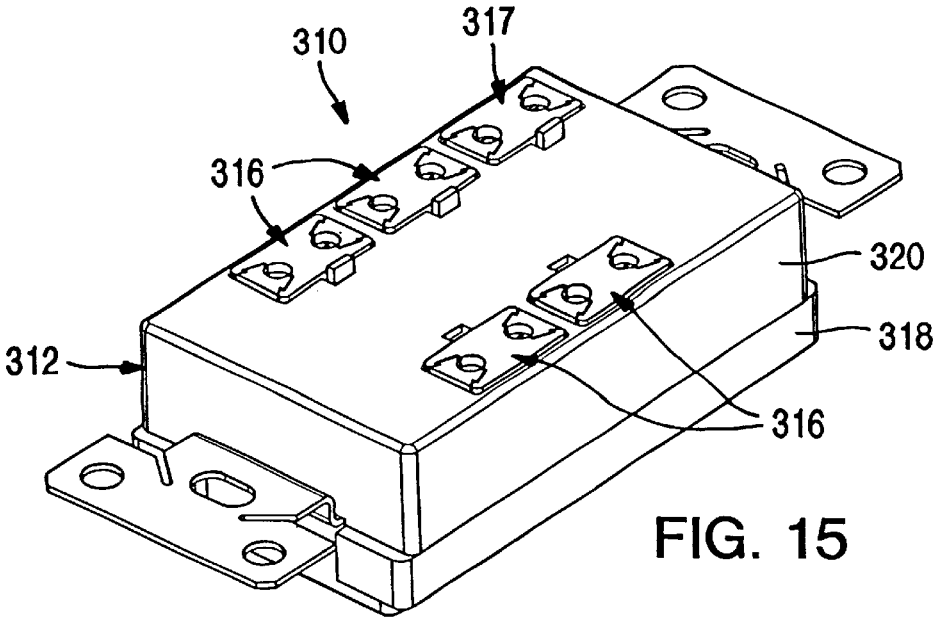
FIG. 15
FIG. 16
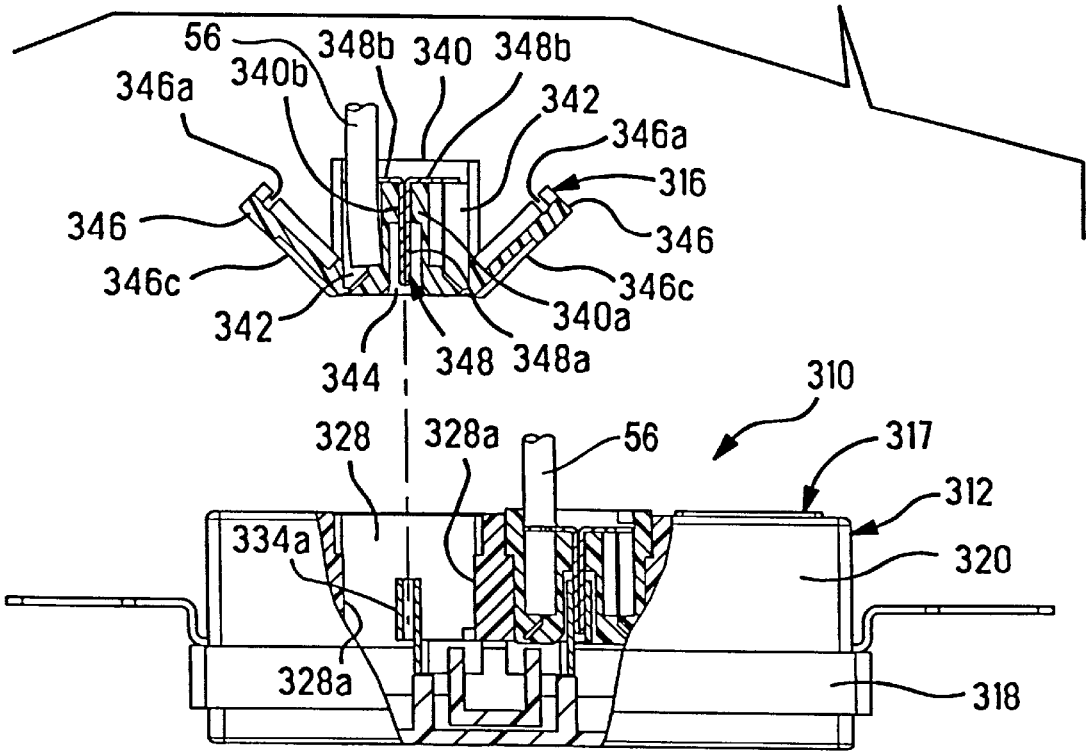

ELECTRICAL COMPONENTS

This application claims the benefit of U.S. Provisional Application(s) No(s). 60/118,252, filed Feb. 2, 1999.

FIELD OF THE INVENTION

The present invention relates to electrical components and more particularly to electrical receptacles and switches having insulation-displacement contacts therein.

BACKGROUND OF THE INVENTION

Electrical receptacles or outlets as well as electrical switches are electrically connected to current-carrying electrical conductors of copper wires covered with insulation. The procedure to electrically connect the electrical conductors to electrical contact members of the receptacles or switches involves the following: strip the insulation to expose wire ends of the copper wires, form the wire ends into hooks, place the hooks under heads and around the shafts of screws of the contact members, and tighten the screws thereby securing the copper wires on the contact members and effecting electrical connections therewith.

Care must be exercised in each of the above steps to insure an effective electrical connection. The insulation must be removed so as not to nick or cut the copper wires, because nicking or cutting the copper wires weakens them and also creates a local spot of increased electrical resistance due to copper material being removed which will result in a local hot spot as electrical current flows through the copper wires. The hooks must be large enough to fit around the screw shafts but small enough to be engaged by the screw heads upon tightening of the screws. None of the insulation must be disposed between the screw heads and the contact members. If insulation is present in the electrical connections, the connecting force applied to the copper wires will be decreased thereby increasing the electrical resistance of the electrical connections. The screws must be tight in order to provide optimum electrical connections; however, overtightening the screws will strip the threads of the screws or the threaded holes of the contact members, thereby resulting in poor electrical connections. Increases in electrical resistance caused by poor electrical connections described above result in increases in temperature during current flow which could also result in ignition of flammable material in close proximity.

SUMMARY OF THE INVENTION

An object of the present invention is to provide electrical receptacles and switches having electrical contact members for electrically connecting insulated electrical conductors without stripping, forming and connecting wires of the electrical conductors by screws.

The present invention is directed to an electrical component for electrical connection to insulated electrical conductors comprising a dielectric housing including a first housing section and a second housing section, first and second electrical contact members disposed in the dielectric housing and having first contacts and second contacts positioned in the first housing section; insulation-displacement contacts as part of the first contacts along which the insulated electrical conductors are positioned, and conductor-moving members for engaging the insulated electrical conductors for moving the insulated electrical conductors into the insulation-displacement contacts thereby effecting electrical connections between the insulation-displacement contacts and the insulated electrical conductors.

BRIEF DESCRIPTION OF THE DRAWINGS

Embodiments of the present invention will now be described by way of example with reference to the accompanying drawings in which:

FIG. 15 is a perspective view of the assembled electrical receptacle of FIG. 14 with the insulation-displacement modules in position.

FIG. 16 is a side view of FIG. 15 partly in cross section and a cross-sectional view of an insulation-displacement module exploded therefrom.

DETAILED DESCRIPTION OF THE INVENTION

Figure 1:
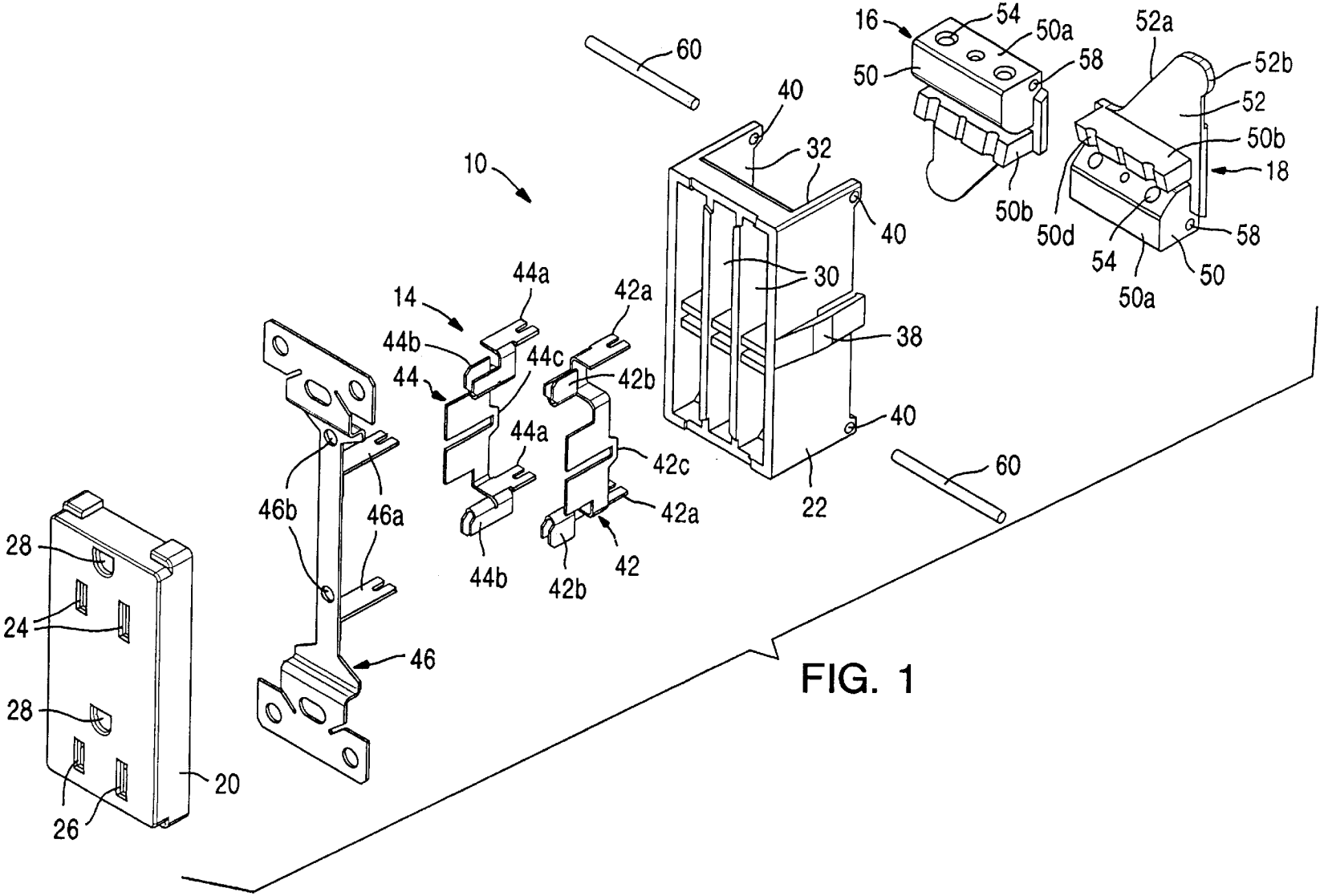
FIG. 1 is an exploded perspective view of the various parts of an electrical receptacle having pivotable conductor-holding members for moving electrical conductors into insulation-displacement contacts.

As shown in FIGS. 1–4, electrical receptacle 10 includes a dielectric housing 12, electrical contact assembly 14, and pivotable conductor-holding members 16, 18.

Dielectric housing 12 includes a first housing section 20 and a second housing section 22. First housing section 20 has upper and lower pairs of slots 24, 26 extending therethrough with one slot being longer than the other. A D-shaped hole 28 is disposed above each pair of slots 24, 26 centrally thereof.

Second housing section 22 has compartments 30 and side walls 32 extending upwardly from a bottom wall 34 having aligned rows of aligned slots 36 spaced inwardly from each end of the bottom wall 34. Resilient latch members 38 are part of side walls 32 and they are located centrally thereof. Holes 40 are located at upper ends of the side walls 32.

Electrical contact assembly 14 includes a first contact member 42, a second contact member 44, and a ground contact member 46. First contact member 42 includes insulation-displacement contacts 42*a*, receptacle contacts 42*b*, and a bridge section 42*c*. Second contact member 44 likewise includes insulation-displacement contacts 44*a*, receptacle contacts 44*b*, and a bridge section (not shown). Ground contact member 46 constitutes a metal-mounting bracket from which insulation-displacement contacts 46*a* extend and holes 46*b* therein containing spring contact members (not shown).

Pivotable conductor-holding members 16, 18 have conductor-holding sections 50 and latching sections 52. Conductor-holding sections 50 have inclined holes 54 extending through an outer section 50*a* in which insulated electrical conductors 56 constituting hot, neutral and ground insulated electrical conductors of an electrical power line are disposed, the outer holes 54 being larger than the middle hole so that the hot and neutral conductors are disposed therein whereas the ground conductor is disposed in the middle hole 54. The conductors abut against a projection 50*c* of an inner section 50*b* of the conductor-holding members 16, 18 which has recesses 50*d* in alignment with respective holes 54. Holes 58 extend through outer sections 50 which receive pins 60 with the ends of pins 60 being disposed in holes 40 in side walls 32 thereby pivotally mounting the conductor-holding members 16, 18 onto second housing section 22 as shown in FIGS. 2–4.

Figure 3:
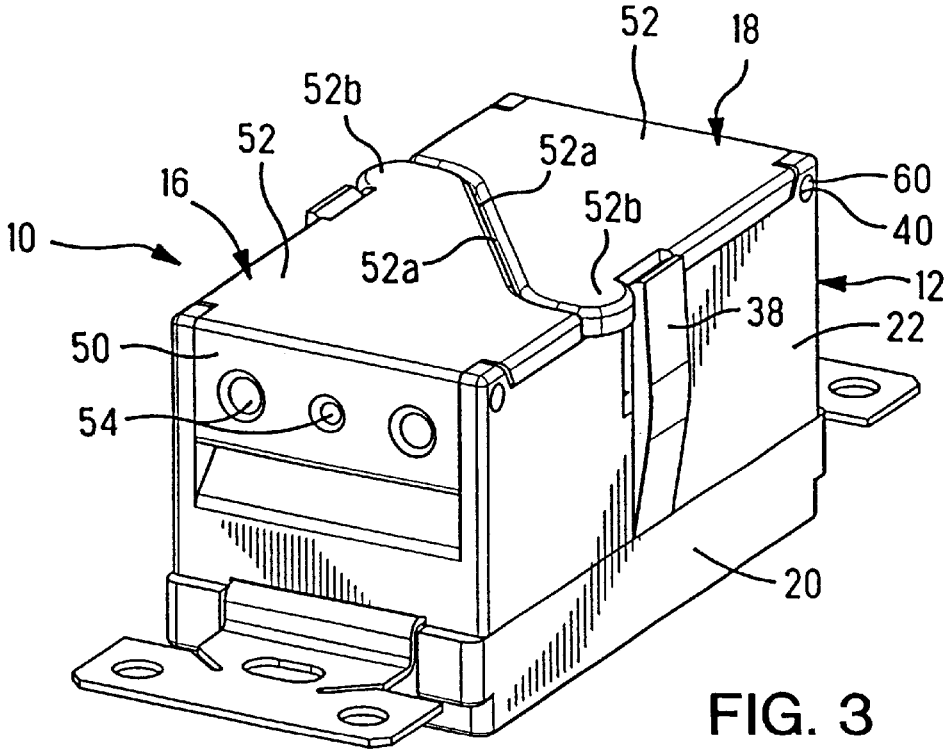
FIG. 3 is a view similar to FIG. 2 showing the conductor-holding members in a closed position.

Latching section 52 of conductor-holding member 16 extends to the left whereas latching section 52 of conductor-holding member 18 extends to the right and they have opposing inclined surfaces 52*a* that extend along each other when the latching members 52 are in a closed and latched position by resilient latch members 38 as shown in FIG. 3. Arcuate projections 52*b* are located at outer ends of the latch members 52 for engagement by an operator as they extend outwardly from the side walls 32.

Figure 2:
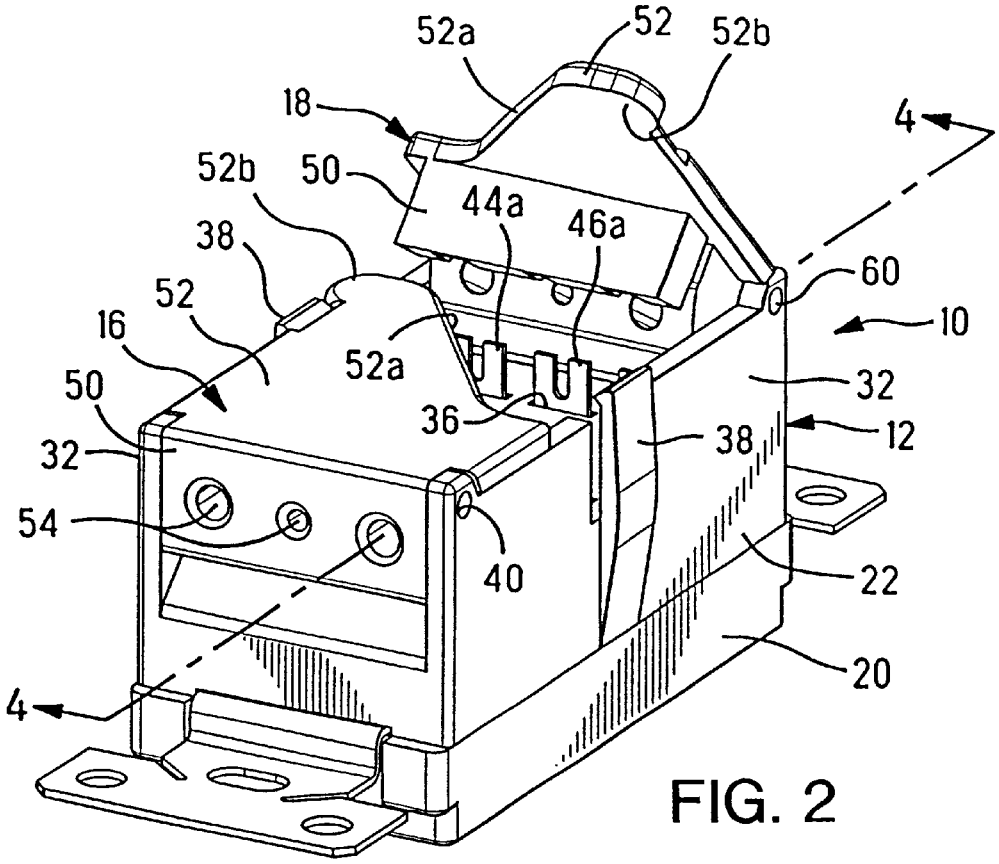
FIG. 2 is a perspective view of an assembled electrical receptacle of FIG. 1 with one of the pivotable conductor-holding members in an open position.
Figure 4:
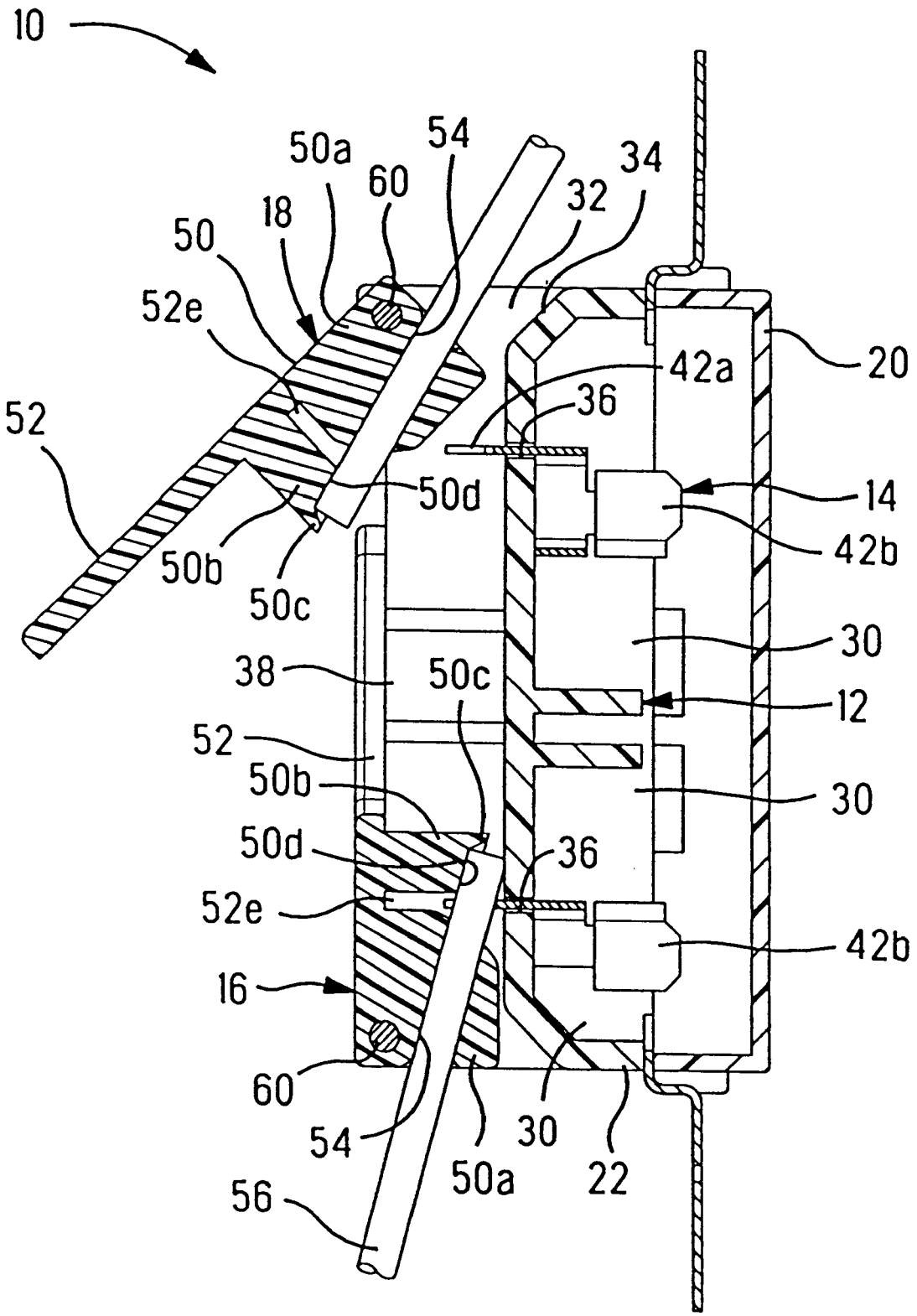
FIG. 4 is a cross-sectional view taken along line 4—4 of FIG. 2 showing the electrical conductors in the conductor-holding members.
Figure 5:
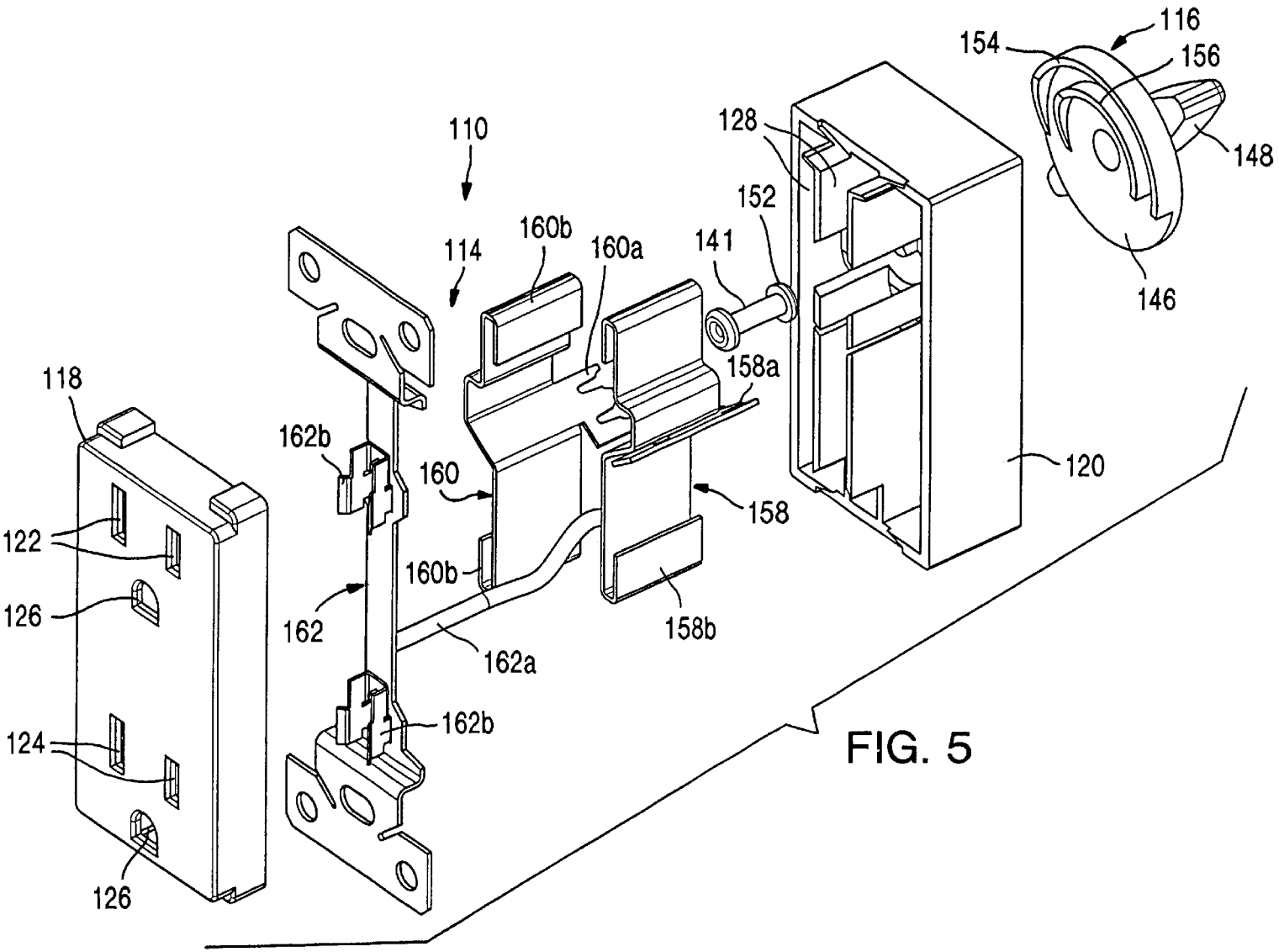
FIG. 5 is an exploded perspective view of the various parts of another embodiment of the electrical receptacle having a rotatable knob for moving the electrical conductors into the insulation-displacement contacts.
Figure 6:
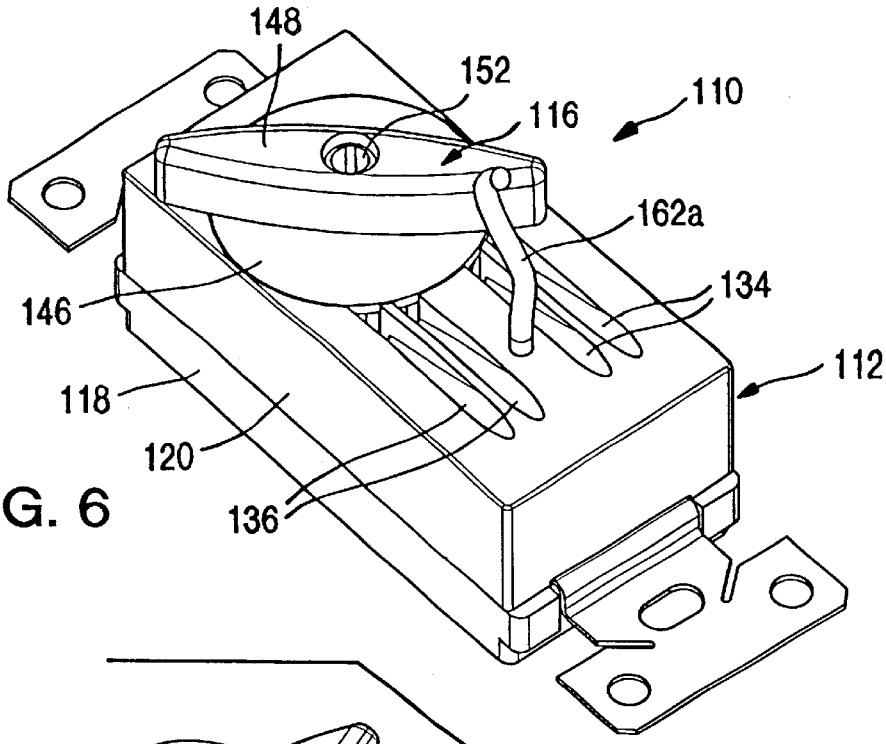
FIG. 6 is a perspective view of the assembled electrical receptacle of FIG. 5.

To assemble electrical receptacle 10, electrical contact members 42, 44 are positioned in the outer compartments 30 of the second housing section 22, and ground contact member 46 extends along the center compartment 30 of the second housing section 22 with the insulation-displacement contacts 42*a*, 44*a*, 46*a* extending through the respective slots 36 in each row thereof so that the insulation-displacement contacts extend outwardly from the bottom wall 34 between the side walls 32 as shown in FIGS. 2 and 4. First housing section 20 is then placed onto the second housing section 22 and they are secured together preferably by rivets (not shown) thereby securing the electrical contact assembly 14 in position therebetween with the receptacle contacts 42*b*, 44*b* being aligned with respective slots 24, 26 and the spring contact members in holes 46*b* being aligned with D-shaped holes 28 in first housing section 20. The conductor-holding members 16, 18 are pivotally mounted onto the walls 32 of the second housing section 22 via pins 60.

To terminate the insulated electrical conductors 56 within the insulation-displacement contacts 42*a*, 44*a*, 46*a*, the insulated electrical conductors 56 of a power line are disposed in holes 54 of the outer sections 52*a* of one of the conductor-holding members 16, 18, which is in an open position. The inner ends of the electrical conductors abut against the projection 50*c* and they are disposed in respective recesses 50*d* whereafter the conductor-holding member is moved to a closed and latched position as shown in FIG. 4 with the insulated electrical conductors 56 being terminated within the respective insulation-displacement contacts 42*a*, 44*a*, 46*a*. The inner section 50*b* acts as a pushing member to push the insulated electrical conductors into the slots of the insulation-displacement contacts whereby the opposing sides of the slots cut through the insulation and electrically engage the conductive cores of the electrical conductors thereby effecting optimum electrical connections between the electrical contact members and the electrical conductors. The insulation-displacement contacts are disposed in a slot 52*e* between the outer and inner sections 50*a*, 50*b*.

The other conductor-holding member is operated in like manner as described above to terminate the insulated electrical conductors of another power line. If desired, the bridge section 42*c* of the electrical contact member 42 and that of the electrical contact member 44 can be removed thereby separating the electrical receptacle 10 into two separate outlets.

FIGS. 5–8 show electrical receptacle 110, which is another embodiment of the present invention. Electrical receptacle 110 includes a dielectric housing 112, electrical contact assembly 114, and a rototable knob 116.

Dielectric housing 112 includes a first housing section 118 and a second housing section 120. First housing section 118 has upper and lower pairs of slots 122, 124 extending therethrough with one slot being longer than the other. A D-shaped hole 126 is disposed below each pair of slots 122, 124 centrally thereof.

Second housing section 120 has compartments 128. Concentric annular recesses 130, 131 are located in a rear surface 132 of the second housing section 120. Pairs of parallel grooves 134. 136 are also located in the rear surface 132, and they are in communication with annular recesses 130, 131. Grooves 134, 136 have inclined arcuate bottom surfaces that descend into the annular recesses 130, 131. Annular recesses 130, 131 surround annular member 138 having a central hole 140. Recesses 142 are located in annular member 138 in alignment with the inner grooves of grooves 134, 136. Slots (not shown) extend into annular recesses 130, 131 and are aligned with respective grooves 134, 136.

Rotatable knob 116 has a circular body 146. An elongated operating member 148 extends outwardly from an upper surface of circular body 146 for engagement by an operator. A hole 150 with a recessed outer section extends through circular body 146 along an axis thereof which receives a hollow shaft 141 disposed in hole 140 of annular member 138. A screw 152 threadably engages internally threaded hollow shaft 151 with the head of screw 152 disposed within the recessed outer section of hole 150 thereby securing rotatable knob 116 onto housing section 120 for rotation relative thereto. Outer and inner cam members 154, 156 extend outwardly from the inner surface of circular body 146 with outer cam member 154 extending along an outer edge thereof, inner cam member 156 is spaced inwardly from the outer cam member 154 and is equally spaced therefrom. The cam members 154, 156 have an arcuate configuration, they are disposed in respective annular recesses 130, 131, and they extend from a low point of operation to a high point of operation as explained hereafter. As can be seen circular body 146 rests against a part-circular wall 133, the upper surface of which is at the same level as the upper surface of annular member 138 so that circular body 146 is disposed so that its outer surface is co-planar with the outer surface of housing section 120.

Electrical contact assembly 114 includes a first contact member 158, a second contact member 160, and a ground contact member 162. First contact member 158 includes insulation-displacement contacts 158*a* and receptacle contacts 158*b*. Second contact member 160 includes insulation-displacement contacts 160*a* and receptacle contacts 160*b*. Ground contact member 162 constitutes a metal-mounting bracket and has a ground lead 162*a* connected thereto extending outwardly therefrom and holes therein containing spring contact members 162*b*.

Figure 7:
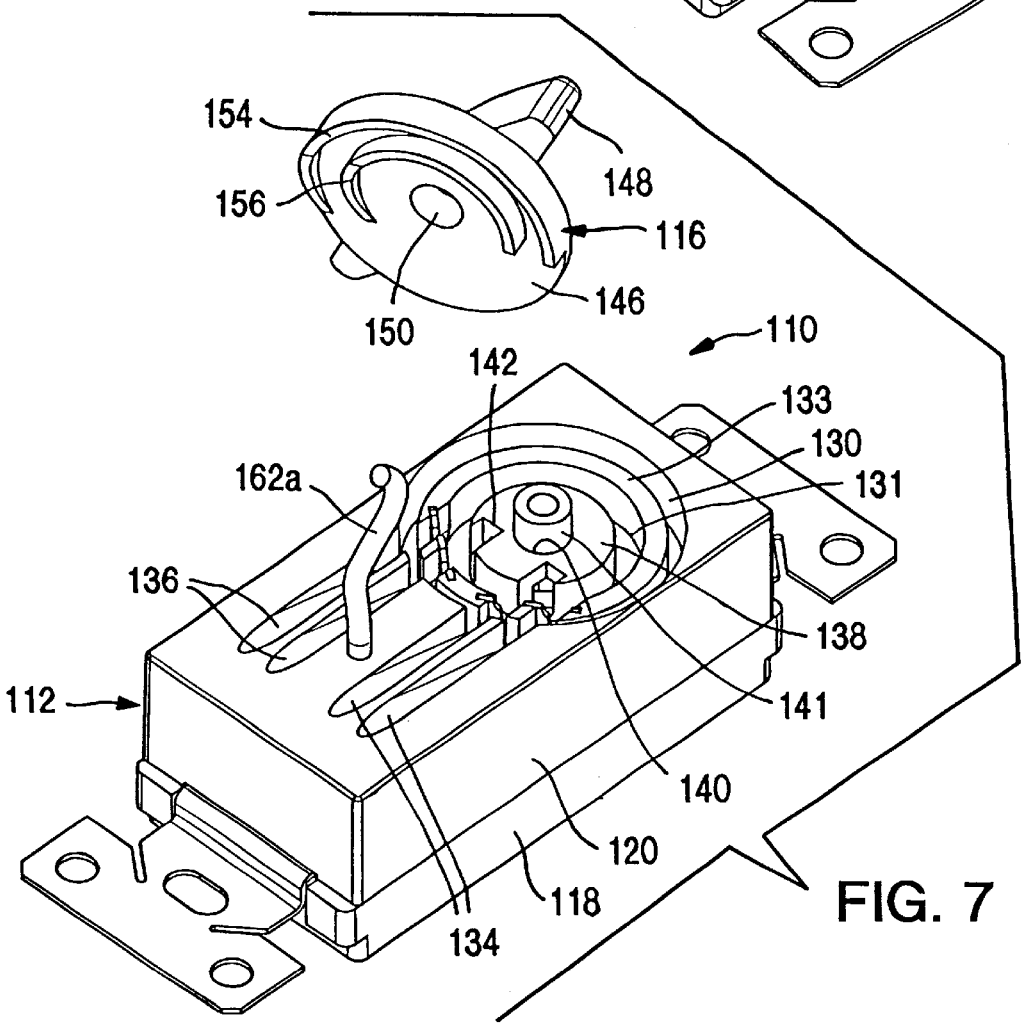
FIGS. 7 and 8 are views similar to FIG. 6 showing the rotatable knob exploded therefrom.
Figure 8:
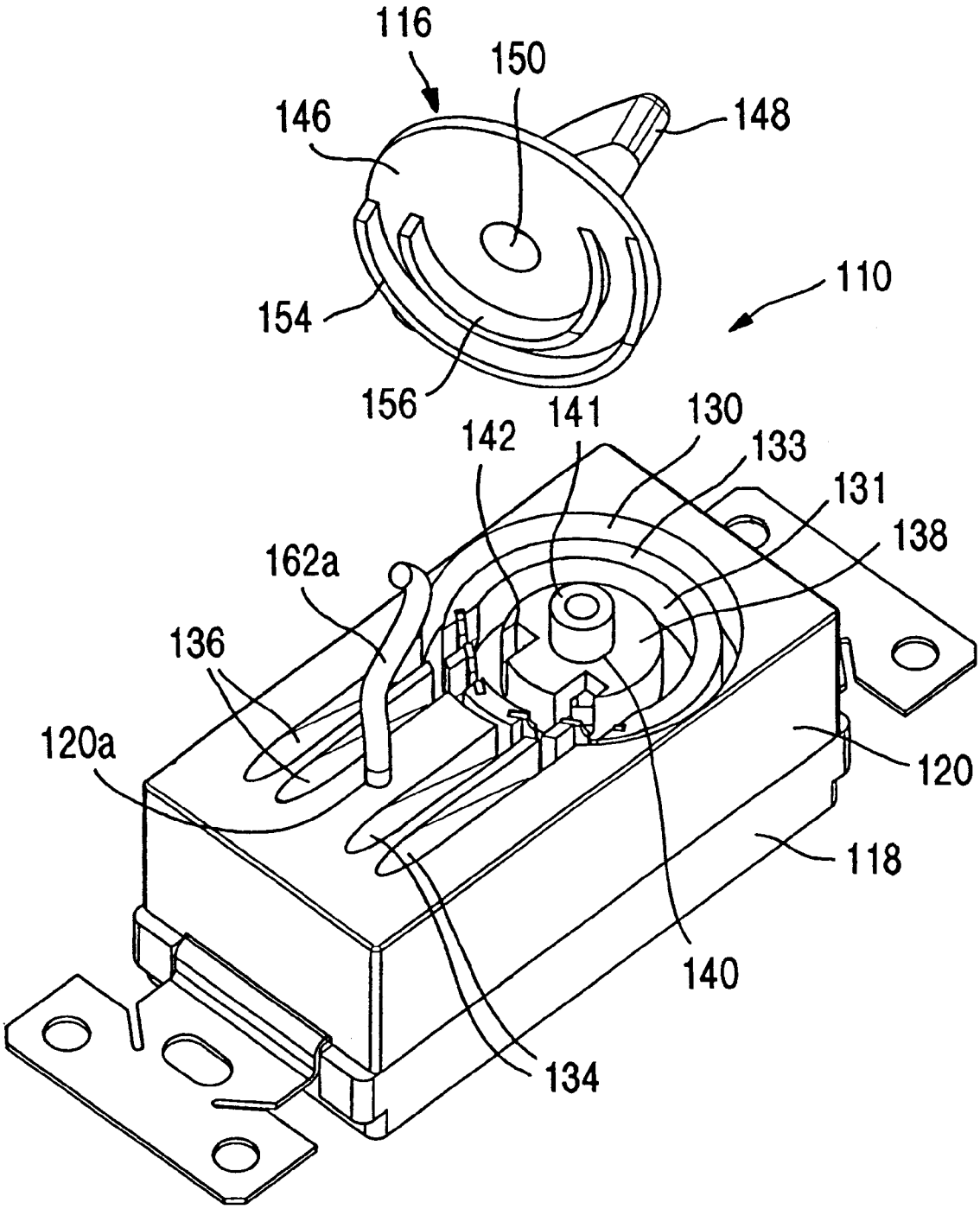
Figure 9:
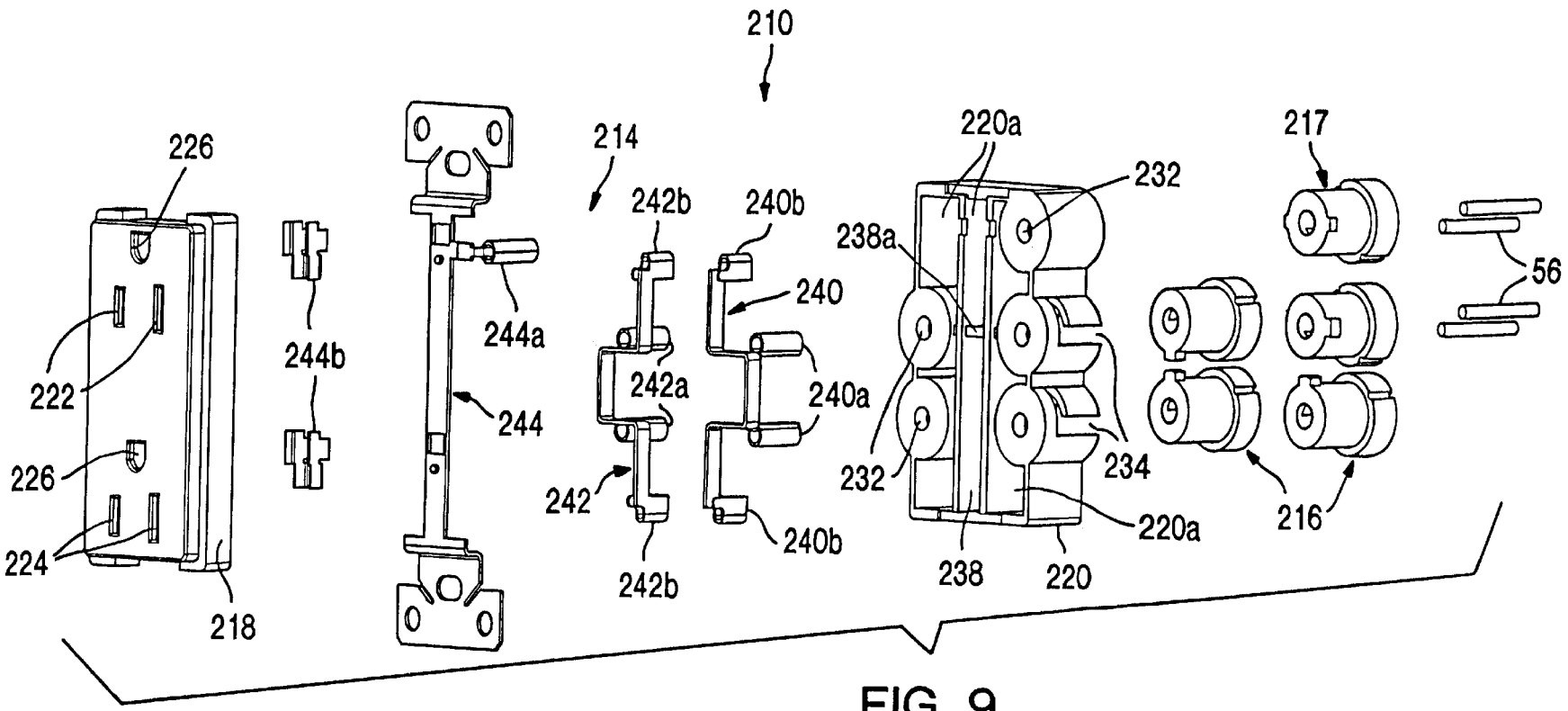
FIG. 9 is an exploded perspective view of the various parts of a further embodiment of the electrical receptacle having insulation-displacement modules for terminating electrical conductors which are electrically connected with the electrical contact members.

To assemble electrical receptacle 110, electrical contact members 158, 160 are positioned in the outer compartments 128 of the second housing section 120, and the ground contact member extends along the center compartment 128 of the second housing section 120 with the insulation-displacement contacts 158*a*, 160*a* extending through the slots into annular recesses 130, 131 as shown in FIGS. 7 and 8. First housing section 118 is then placed onto the second housing section 120 and they are secured together preferably by rivets (not shown) thereby securing the electrical contact assembly 114 in position within housing 112 with the receptacle contacts 158*b*, 160*b* being aligned with respective slots 122, 124 and the spring contact members 162*b* being aligned with D-shaped holes 126 in first housing section 118. The ground lead 162*a* extends through a hole 120*a* in housing section 120 and outwardly therefrom.

To terminate the insulated electrical conductors 56 within the insulation-displacement contacts 158*a*, 160*a*, rotatable knob 116 is rotated to a position whereby the lowest height of the arcuate cam members 154, 156 are disposed over the insulation-displacement contacts 158*a*, 160*a*. This leaves adequate space to position the insulated electrical conductors within the grooves 134, 136 so that the ends of the insulated electrical conductors in the inner grooves are disposed in the recesses 142 and the ends of the insulated electrical conductors in the outer grooves abut against annular member 138 thereby positioning the ends of the insulated electrical conductors over the insulation-displacement contacts 158*a*, 160*a*. Rotatable knob 116 is then rotated whereby the arcuate cam members 154, 156 force the ends of the insulated electrical conductors within the slots of the insulating-displacement contacts whereby electrical terminations are effected therebetween thereby resulting in optimum electrical connections.

The conductors in grooves 134 are connected to one side of the power line and the conductors 56 in grooves 136 are connected to the other side of the power line.

FIGS. 9–13 show electrical receptacle 210, which is a further embodiment of the present invention. Electrical receptacle 210 includes a dielectric housing 212, electrical contact assembly 214, and insulation-displacement modules 216, 217.

Dielectric housing 212 includes a first housing section 218 and a second housing section 220. First housing section 218 has upper and lower pairs of slots 222, 224 extending therethrough with one slot being longer than the other. A D-shaped hole 226 is disposed above each pair of slots 222, 224 centrally thereof.

Figure 10:
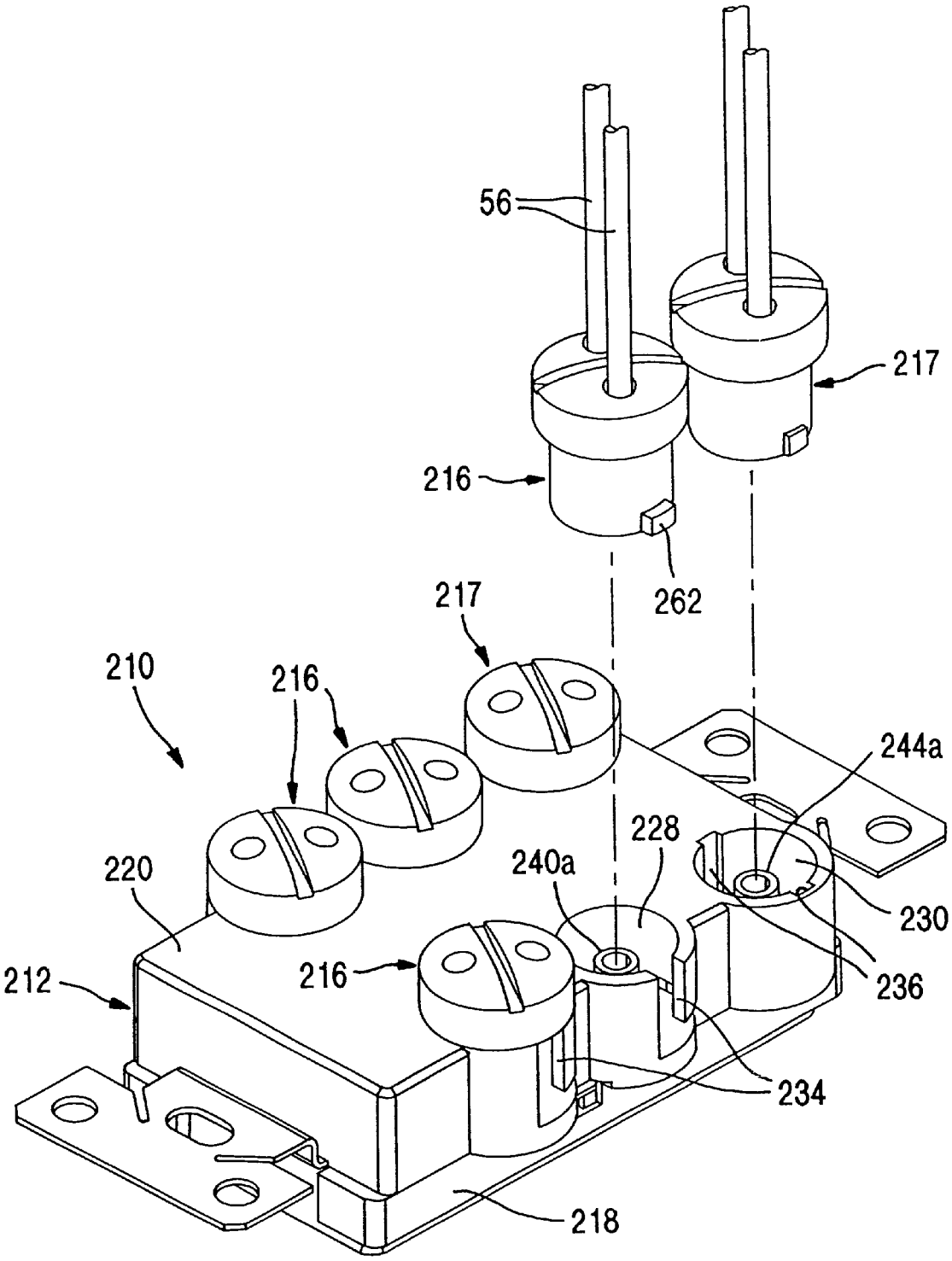
FIG. 10 is a perspective view of the assembled electrical receptacle of FIG. 9 with insulation-displacement modules exploded therefrom.

Second housing section 220 includes circular cavities 228, 230 extending inwardly from an outer surface (see FIG. 10). Pairs of cavities 228 are located along the sides of second housing section 220 and a single cavity 230 is located adjacent one pair of cavities 228. Holes 232 extend through the bottom walls of the cavities. L-shaped slots 234 are located in the outer walls of cavities 228; and opposing internal recesses 236 are located in the wall of cavity 230 (see FIG. 10), and they communicate with arcuate recesses (not shown) at the bottom of recesses 236. An elongated cavity 238 extends inwardly from an inner surface of the second housing section 220 between parallel walls 220*a* and a projection 238*a* is located centrally thereof.

Electrical contact assembly 214 includes a first contact member 240, a second contact member 242, and a ground contact member 244. First contact member 240 includes annular receptacle contacts 240*a* and receptacle contacts 240*b*. Second contact member 242 includes annular receptacle contacts 242*a* and receptacle contacts 242*b*. Ground contact member 244 constitutes a metal-mounting bracket and has an annular receptacle contact 244*a* extending outwardly therefrom and holes therein containing spring contact members 244*b* disposed therein.

Figure 11:
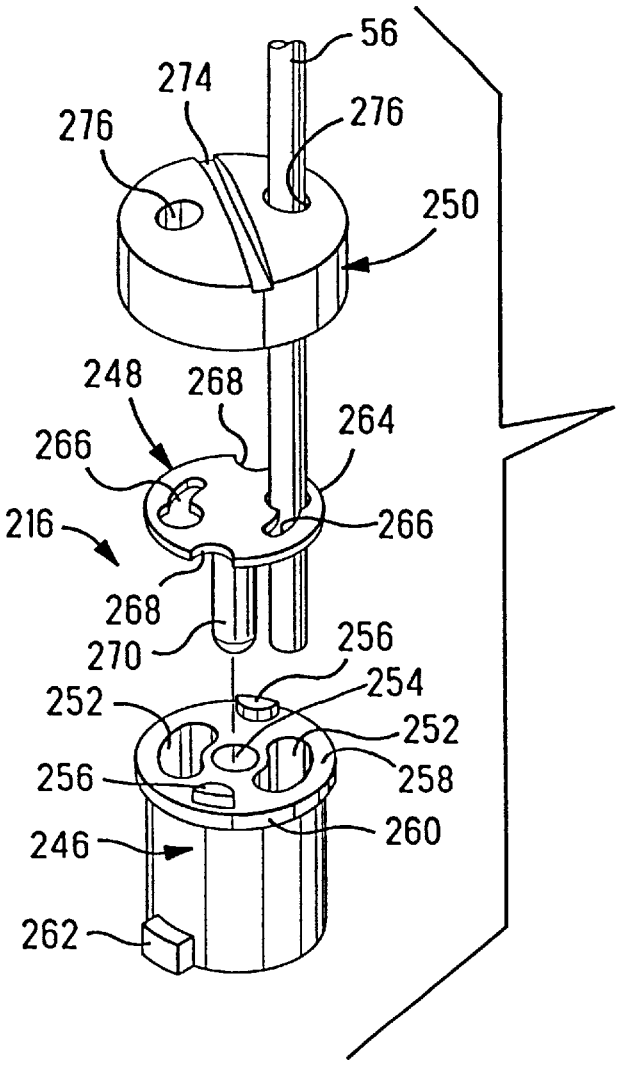
FIG. 11 is an exploded perspective view of an insulation-displacement module.
Figure 12:
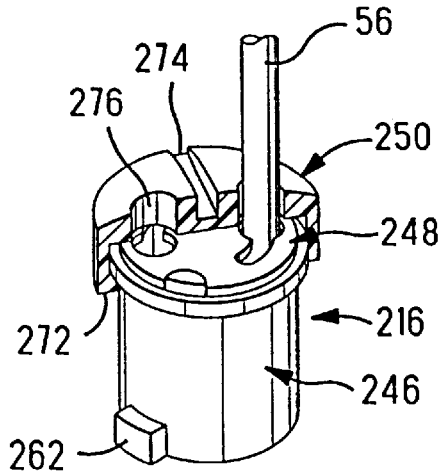
FIG. 12 is a perspective view partly in cross section of an assembled insulation-displacement module with an electrical conductor therein prior to termination thereof.
Figure 13:
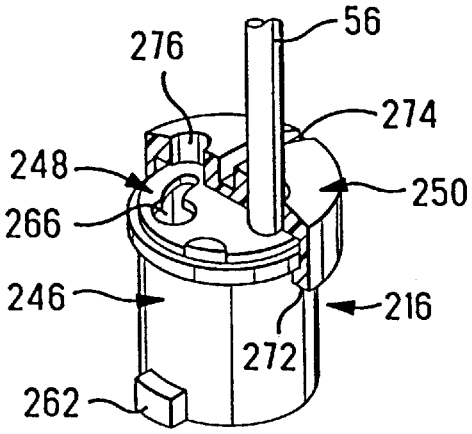
FIG. 13 is a view similar to FIG. 12 showing the termination of the electrical conductor.
Figure 14:
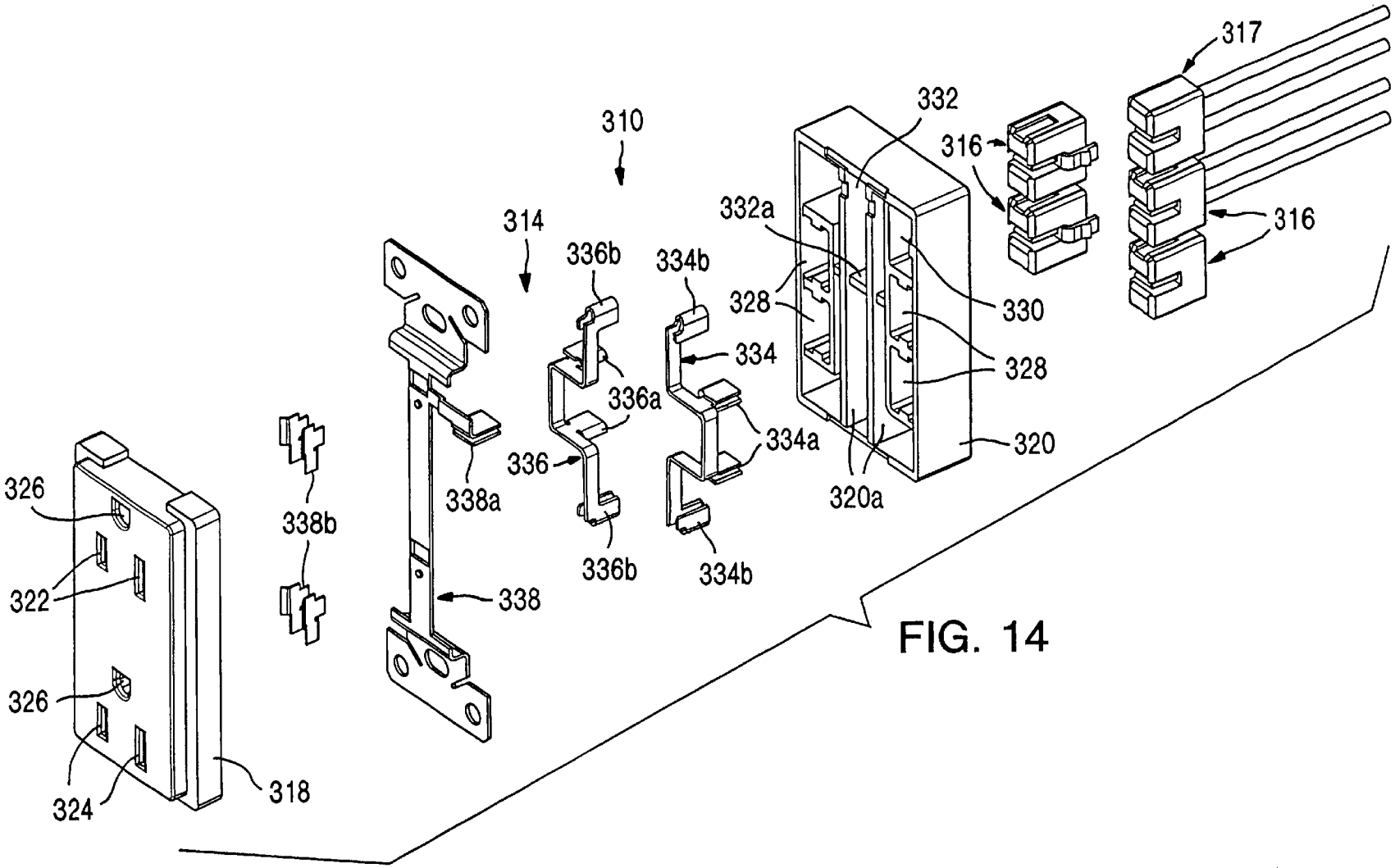
FIG. 14 is an exploded perspective view of the various parts of an additional embodiment of the electrical receptacle having another version of insulation-displacement modules for terminating electrical conductors which are electrically connected with the electrical contact members.

Annular insulation-displacement modules 216 are disposed in the pairs of cavities 228 along each side of the second housing section 220 and the insulation-displacement module 217 is disposed in cavity 230. Insulation-displacement modules 216 as shown in FIGS. 11–13 include a dielectric cylindrical housing 246, an insulation-displacement contact 248, and a dielectric cap member 250. Cylindrical housing 246 has arcuate cavities 252 parallel to a central hole 254, opposing U-shaped projections 256 extending upward from an upper surface 258 of housing 246, an annular rim 260 at an upper end of housing 246, and a projection 262 extending outwardly from an outer surface of housing 246 at a bottom end thereof.

Insulation-displacement contact 248 includes a metal disc 264 having opposed comma-shaped slots 266, opposed U-shaped recesses 268, and a pin contact 270 extending from metal disc 264.

Cap member 250 has an inwardly-directed lip 272, a slot 274 disposed across an upper surface of the cap member and between holes 276 extending therethrough.

Insulation-displacement modules 217 are the same as insulation-displacement modules 216 except that projections 262 extend outwardly from the housing at opposing locations therefrom.

To assemble electrical receptacle 210, annular receptacle contacts 240*a* of the first contact member 240 and annular receptacle contacts 242*a* of the second contact member 242 are disposed in holes 232 of the pairs of cavities 228 of the second housing section 220 and receptacle contacts 240*b*, 242*b* are disposed along respective walls 220*a*, and the ground contact member 244 extends along elongated cavity 238 with annular receptacle contact 244*a* being disposed in the hole 232 of cavity 230. First housing section 218 is then placed onto the second housing section 220 and they are secured together preferably by rivets (not shown) thereby securing the electrical contact assembly 214 in position within housing 212 with the receptacle contacts 240*b*, 242*b* being aligned with respective pairs of slots 222, 224 and the spring contact members 244*b* in the holes being aligned with D-shaped holes 226 in first housing section 218.

To assemble insulation-displacement modules 216, 217, pin contacts 270 are disposed in holes 254 of housings 246 and metal discs 264 are positioned on upper surfaces 258 with U-shaped projections 256 being disposed in U-shaped recesses 268 thereby maintaining insulation-displacement contacts 248 in position on ousings 246 with comma-shaped slots 266 overlying rcuate cavities 252. Cap members 250 are snapped onto housings 246 with inwardly-directed lips 272 being disposed along the bottom surfaces of annular rims 260 enabling the cap members 250 to rotate relative to the housings 246.

To terminate insulated electrical conductors 56 in insulation-displacement modules 216, 217, insulated electrical conductors of one side of a power line are inserted into holes 276 of the cap member 250, through the large sections of the comma-shaped slots 266 and into arcuate cavities 252. A blade of a screw driver is then inserted into slot 274 and the cap member 250 is turned thereby causing the insulated electrical conductors to be forced into the small sections of the comma-shaped slots 266 whereby the sides of the comma-shaped slots cut through the insulation of the insulated electrical conductors effecting electrical connections therebetween. The insulated electrical conductors of the other side of the power line and the ground insulated electrical conductors are terminated in like manner in the respective insulation-displacement modules 216, 217.

The insulation-displacement modules 216 are positioned within cavities 228 with the pin contacts 270 electrically connecting with the annular receptacle contacts 240*a*, 242*a*, projections 262 moving along L-shaped slots 234 and then moving the projections 262 into the short legs of the L-shaped slots 234 thereby latching the insulation-displacement modules 216 in position in housing 212.

As regards insulation-displacement module 217, it is positioned in cavity 230 with the pin contact 270 electrically connecting with the annular receptacle contact 244*a*, projections 262 moving along recesses 236 and then moving the projections 262 into the arcuate slots thereby latching the insulation-displacement module 217 in position in housing 212.

Thus, both sides of the power line and the ground side thereof are electrically connected to the outlets of the electrical receptacle 210.

FIGS. 14–18 show electrical receptacle 310, which is an additional embodiment of the present invention. Electrical receptacle 310 includes a dielectric housing 312, electrical contact assembly 314, and insulation-displacement modules 316, 317.

Dielectric housing 312 includes a first housing section 318 and a second housing section 320. First housing section 318 has upper and lower pairs of slots 322, 324 extending therethrough with one slot being longer than the other. A D-shaped hole 326 is disposed above each pair of slots 322, 324 centrally thereof.

Second housing section 320 includes rectangular cavities 328, 330 extending therethrough. Pairs of cavities 328 are located along the sides of second housing section 320 and a single cavity 330 is located adjacent a pair of cavities 328. Projections 328*a* are located on opposing end walls of cavities 328 and projections 330*a* are located on opposing side walls of cavities 330. An elongated cavity 332 extends inwardly from an inner surface of the second housing section 320 between parallel walls 320*a* and a projection 332*a* is located centrally thereof.

Electrical contact assembly 314 includes a first contact member 334, a second contact member 336, and a ground contact member 338. First contact member 334 includes first receptacle contacts 334*a* that are parallel to one another and second receptacle contacts 334*b* that are aligned with each other. Second contact member 336 includes first receptacle contacts 336*a* that are parallel to one another and second receptacle contacts 336*b* that are aligned with each other. Ground contact member 338 constitutes a metal-mounting bracket and has receptacle contact 338*a* extending outwardly therefrom and holes therein containing spring contact members 338*b*.

Figure 17:
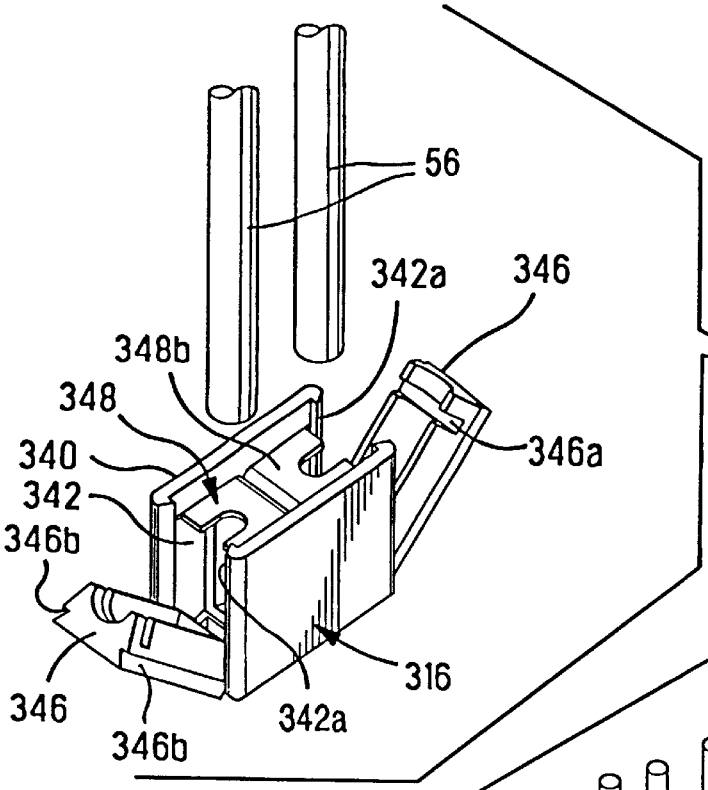
FIG. 17 is a perspective view of an insulation-displacement module prior to terminating electrical conductors therein.
Figure 18:
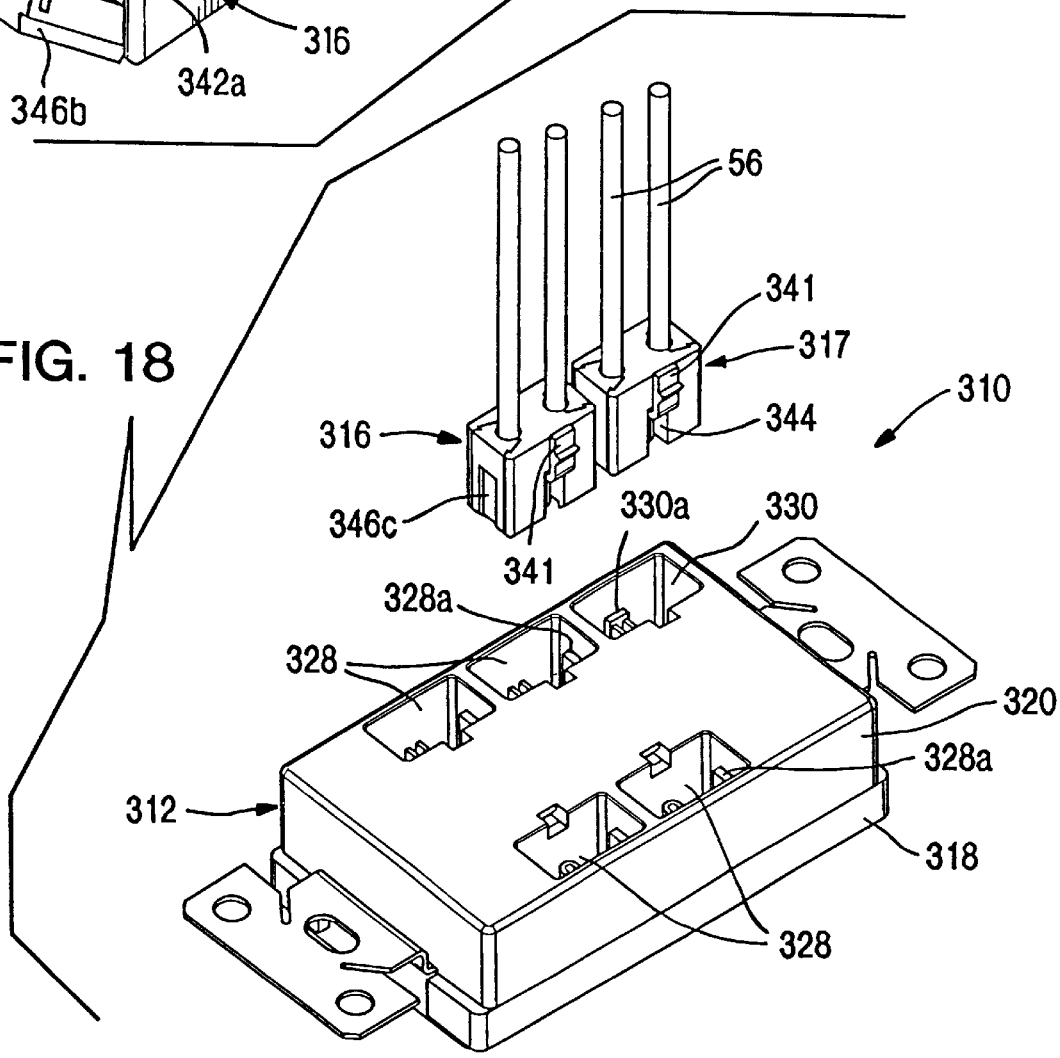
FIG. 18 is a view similar to FIG. 15 with insulation-displacement modules terminated to electrical conductors exploded therefrom.

Rectangular insulation-displacement modules 316 are disposed in the pairs of cavities 328 along each side of the second housing section 320 and the insulation-displacement module 317 is disposed in the cavity 330. Insulation-displacement module 316 as shown in FIGS. 16–18 includes a dielectric rectangular housing 340 having end cavities 342 and a central cavity 344 extending inwardly from a bottom surface thereof to a central section 340*a* having a slot 340*b* extending therethrough. Cover members 346 are hingedly connected at their bottom ends to a bottom of housing 340 and they have arcuate inner surfaces separated by a slot 346*a*. Latching surfaces 346*b* extend along the sides of the cover members 346 and they mate with inwardly-directed projections 342*a* that extend along outer ends of the end cavities 342 thereby latching the cover members 346 in a closed position as shown in FIG. 18. Outer surfaces of the cover members 346 have recesses 346*c* therein for mating engagement with the projections 328*a* in the cavities 328 to make certain that insulation-displacement modules 316 are positioned only in the cavities 328.

Insulation-displacement contact 348 is stamped and formed from a metal sheet; it includes a folded-back blade contact 348*a* that is disposed in slot 340*b* of central section 340*a* of housing 340 and extends into the central cavity 344 in the form of a U-shaped recess (see FIG. 16), and slotted insulation-displacement contacts 348*b* at an inner end of the blade contact 348*a* which are disposed normal thereto and engage an upper surface of central section 340*a*. The inner surfaces of cavities 342 along the central section 340*a* are arcuate.

Insulation-displacement module 317 is the same as insulation-displacement modules 316 except that projections 330*a* in cavity 330 mate with the U-shaped recess 344 in the insulation-displacement module 317 so that only such module can be positioned within cavity 330.

To assemble electrical receptacle 310, first and second contact members 334, 336 are positioned along the inner surfaces of the second housing section 320 with the first receptacle contacts 334*a*, 336*a* being disposed within respective cavities 328 and second receptacle contacts 334*b*, 336*b* are disposed along respective walls 320*a*, and the ground contact member 338 extends along elongated cavity 332 with receptacle contact 338*a* being disposed in respective cavity 330. First housing section 318 is then placed onto the second housing section 320 and they are secured together preferably by rivets (not shown) thereby securing the electrical contact assembly 314 in position within housing 312 with the second receptacle contacts 334*b*, 336*b* being aligned with the respective pairs of slots 322, 324 and the spring contact members 338*b* in the holes being aligned with the D-shaped holes 326.

To terminate the insulated electrical conductors 56 of both sides of power lines in respective insulation-displacement modules 316 and position them in respective cavities 328 so that the blade contacts 348*a* are electrically connected with the first receptacle contacts 334*a*, 336*a* in the cavities 328, a pair of insulated electrical conductors 56 are placed in respective cavities 342 of housing 340 with the cover members 346 in an open position. The cover members 346 are then moved to a partly-closed position; a tool, such as a pliers, is then used to completely close the cover members 346 to latched positions thereby causing the insulated electrical conductors to be forced into the slots of the insulation-displacement contacts 348*b* and effecting optimum electrical connections therebetween with the outer ends of the insulation-displacement contacts being disposed in slots 346*a* in the cover members 346.

A similar termination procedure is followed when terminating the ground insulated electrical conductors in the insulation-displacement modules 317 which can be inserted into cavity 330.

Latching means (not shown) can be readily provided by the second housing section 320 at each of the cavities 328, 330 which latch with resilient latch members 341 on each of the housings 340 of the insulation-displacement modules 316, 317 to latch the modules in position in the cavities. Many other forms of latching means can of course be used.

One of the electrical contact members of each of the electrical receptacles 10, 110, 210, 310 can be constructed so as to include power interruption members to provide electrical safety receptacles as disclosed in U.S. patent application Ser. No. 09/301,269 filed Apr. 28, 1999.

Figure 19:
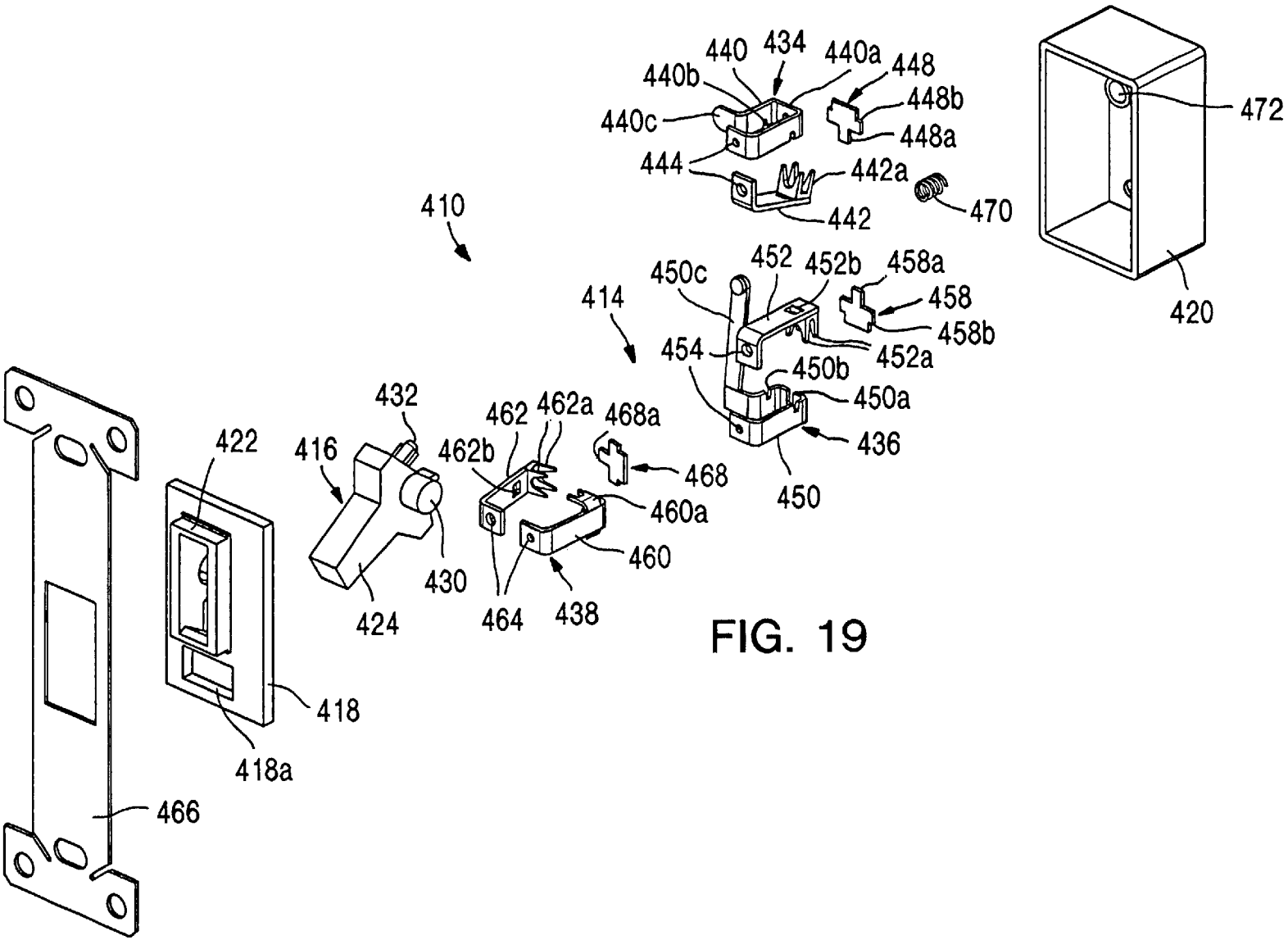
FIG. 19 is an exploded perspective view of various parts of an electrical switch having insulation-displacement contacts for terminating electrical conductors.
Figure 20:
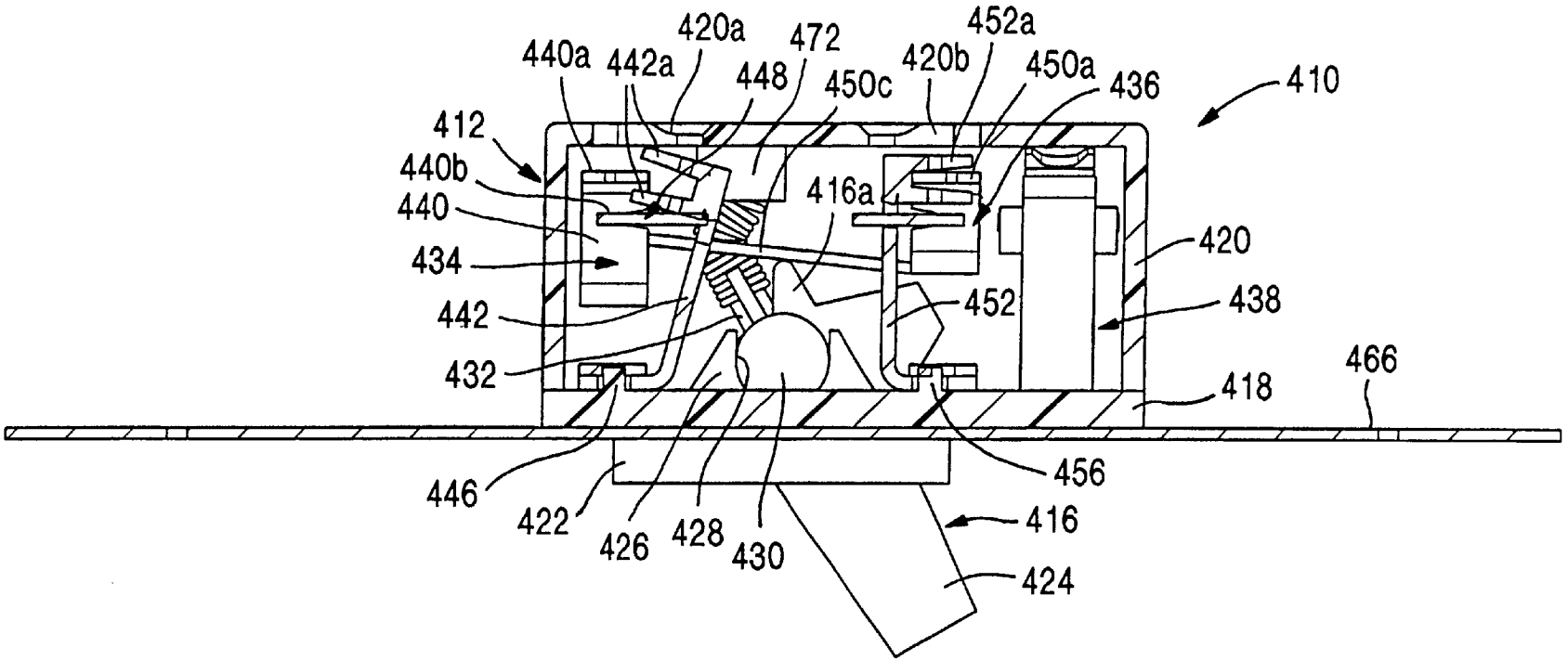
FIG. 20 shows a cross-sectional view of an assembled switch of FIG. 19 taken along line 20—20 of FIG. 21.
Figure 21:
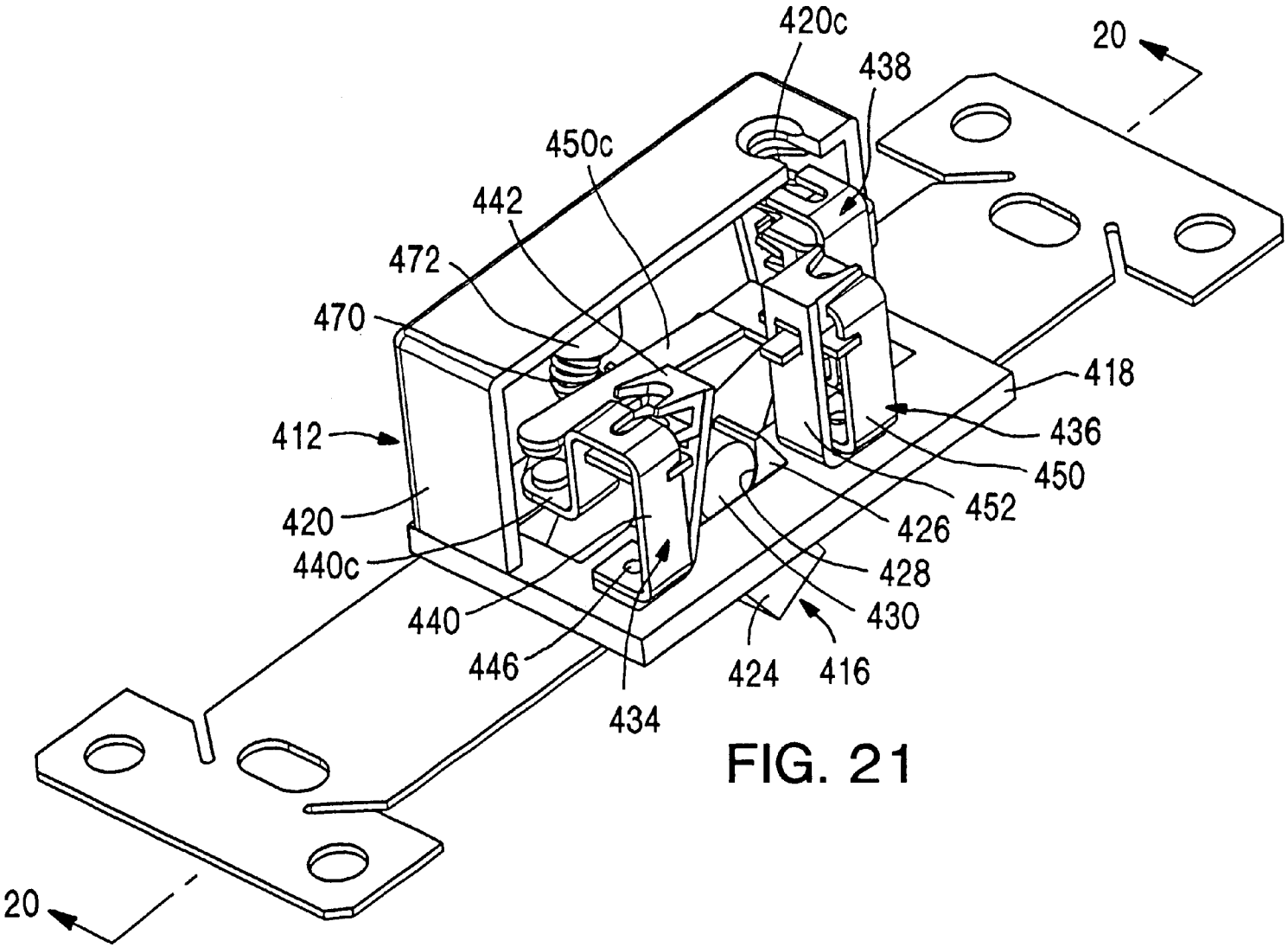
FIG. 21 is a perspective view of FIG. 20 partly in cross-section.

An electrical switch 410 shown in FIGS. 19–21 includes a dielectric housing 412, electrical contact assembly 414 and actuating member 416.

Dielectric housing 412 includes a first housing section 418 and a second housing section 420. First housing section 418 includes a rectangular projection 422 extending outwardly from a front surface thereof which delineates a rectangular opening through which actuating section 424 of the actuating member 416 extends as shown in FIGS. 20, 21. Pivot members 426 having arcuate pivot surfaces 428 extend outwardly from an inner surface of the first housing section 418 within the rectangular opening so that annular pivot members 430 of the actuating member 416 are disposed therein. A projection 432 extends outwardly from a back end of the actuating member 416.

Electrical contact assembly 414 includes a first contact member 434, a second contact member 436 and a ground contact member 438. First contact member 434 includes a stationary contact 440 and a movable contact 442. The bottom ends of stationary contact 440 and movable contact 442 are bent inwardly, and they have holes 444 so as to heat stake them onto a projection 446 on an inner surface of the first housing section 418. A trip member 448 is disposed between the stationary contact 440 and the movable contact 442 to normally position the movable contact 442 away from the stationary contact 440 so that insulating-displacement contacts 440*a*, 442*a* are separated from each other. Trip member 448 has an extension 448*a* that extends through an aperture (not shown) in the movable contact 442 adjacent the insulation-displacement contacts 442*a* and shoulders 448*b* that are disposed in recesses 440*b* in opposing legs of the stationary contact 440. A contact section 440*c* is located at a free end of one of the opposing legs of the stationary contact 440. The insulation-displacement contacts 440*a*, 442*a* are in alignment with an elongated aperture 420*a* of the second housing section 420 (see FIG. 20).

Second contact member 436 includes a stationary contact 450 and a movable contact 452. The bottom ends of stationary contact 450 and movable contact 452 are bent inwardly, and they have holes 454 so as to heat stake them onto a projection 456 on the inner surface of the first housing section 418. A trip member 458 is disposed between the stationary contact 450 and the movable contact 452 to normally position the movable contact 452 away from the stationary contact 450 so that insulation-displacement contacts 450*a*, 452*a* are separated from each other. Trip member 458 has an extension 458*a* that extends through an aperture 452*b* in the movable contact 452*b* and shoulders 458*b* that are disposed in recesses 450*b* in opposing legs of the stationary contact 450. A cantilever contact section 450*c* is normally in electrical engagement with contact section 440*c* and it extends outwardly from a free end of one of the opposing legs of the stationary contact 440. The insulation-displacement contacts 450*a*, 452*a* are in alignment with an elongated aperture 420*b* in the second housing section 420 (see FIG. 20).

Ground contact member 438 includes a stationary contact 460 and a movable contact 462. The bottom ends of the stationary contact 460 and the movable contact 462 are bent inwardly, and they have holes 464 so as to rivet them to metal-mounting bracket 466 through rectangular opening 418*a* in the first housing section 418. Metal-mounting bracket 466 has a rectangular opening 466*a* in which rectangular projection 422 of the first housing section 418 is disposed. A trip member 468 is disposed between the stationary contact 460 and the movable contact 462 to normally position the movable contact 462 away from the stationary contact 460 so that insulation-displacement contacts 460*a*, 462*a* are separated from each other. Trip member 468 has an extension 468*a* that extends through an aperture 462*b* in the movable contact 462 and a front end that engages the stationary contact 460. The insulation-displacement contacts 460*a*, 462*a* are in alignment with an elongated aperture 420*c* of the second housing section 420 (see FIG. 21).

A coil spring 470 has one end disposed in an annular projection 472 located on an inner surface of a bottom wall of the second housing section 420 while the other end of the coil spring 470 is disposed onto projection 432 of the actuating member 416. Another projection 416*a* extends outwardly from the back end of the actuating member 416 and engages the cantilever section 450*c* to disconnect it from the contact section 440*c* when the actuating member 416 is moved to an off position thereby interrupting the electrical circuit connected to the switch 410.

Ends of insulated electrical conductors are respectively inserted through elongated apertures 420*a*, 420*b* and between the insulation-displacement contacts 440*a*, 442*a* of the first contact member 434 and between the insulation-displacement contacts 440*a*, 442*a* of the first contact member 434 and between the insulation-displacement contacts 450*a*, 452*a* of the second contact member 436. The ends of the insulated electrical conductors engage trip members 448, 458 thereby releasing the movable contacts 442, 452 and enabling them to spring toward the stationary contacts 440, 450 so that the insulation-displacement contacts 440*a*, 442*a*; 450*a*, 452*a* electrically connect to the insulated electrical conductors.

An end of an insulated ground conductor is inserted through elongated aperture 420*c* and between the insulation-displacement contacts 460*a*, 462*a* of the ground contact member 438 whereby the end of the insulated ground conductor engages the trip member 468 which released the movable contact 462 to spring toward the stationary contact 460 so that the insulation-displacement contacts 460*a*, 462*a* electrically connects to the insulated ground conductor.

The spring force generated by the movable contacts 442, 452, 462 will drive the insulated electrical and ground conductors so that the conductors are effectively electrically connected between the insulation-displacement contacts 440*a*, 442*a*; 450*a*, 452*a*; 460*a*, 462*a*.

Electrical switch 410 with the electrical contact members 434, 436, 438 thereof enables insulated electrical conductors and an insulated ground conductor to be electrically connected to the electrical contact members without having to strip insulation from the conductors and then bending them around shanks of screws and then tightening the screws as is the case in conventional electrical switches. This saves labor and results in excellent electrical connections.

Embodiments of the electrical receptacles and electrical switch of the present invention have been disclosed above. The advantages of the present invention are as follows: the insulated electrical conductors do not have to have their ends stripped of insulation to expose the copper wires. The ends do not have to be formed into hooks which are then secured to electrical contacts by screws which may not be properly tightened, but if tightened too much, the screw threads of the screws or threaded holes may be stripped thereby resulting in faulty electrical connections that could cause increased temperature due to increased resistance thereby resulting in a fire. The insulated electrical conductors are terminated by insulation-displacement contacts thereby resulting in reliable optimum electrical connections requiring less work.

What is claimed is:

1. An electrical component for electrically connecting insulated electrical conductors thereto, comprising a dielectric housing including a first housing section and a second housing section;

first and second electrical contact members disposed in the dielectric housing and having first contacts extending into the second housing section;

insulation-displacement contacts as part of the first contacts along which the insulated electrical conductors are positioned;

conductor-moving members for engaging the insulated electrical conductors for moving the insulated electrical conductors into the insulation-displacement contacts thereby effecting electrical connections between the insulation-displacement contacts and the insulated electrical conductors; and the first housing section includes slots in alignment with second contacts of the first and second electrical contact members within the first housing section.

2. An electrical component as claimed in claim 1, wherein the first contacts are the insulation-displacement contacts extending through slots in the second housing section into a recess thereof.

3. An electrical component as claimed in claim 2, wherein the recess is defined by a bottom wall of the second housing section and opposing side walls, the slots are aligned through which the insulating-displacement contacts extend.

4. An electrical component as claimed in claim 3, wherein the conductor-moving members are conductor-holding members pivotally mounted to the opposing side walls and including outer sections having holes in which the insulated electrical conductors are disposed and inner sections having recesses in which ends of the insulated electrical conductors are disposed whereby the inner sections operate as pusher members for pushing the ends of the insulated electrical conductors into the insulation-displacement contacts.

5. An electrical component as claimed in claim 2, wherein the recess is an annular recess extending inwardly from an outer surface of the second housing section; pairs of grooves extending inwardly from the outer surface and communicating with the annular recess, the slots are aligned with the respective grooves so that when the insulated electrical conductors are positioned in the grooves the ends of the insulated electrical conductors are disposed onto the insulation-displacement contacts.

6. An electrical component as claimed in claim 5, wherein the conductor-moving members are arcuate cam members on a rotatable knob rotatably mounted on the second housing section with the arcuate cam members being disposed in the annular recess so that when the rotatable knob is rotated the arcuate cam members force the ends of the insulated electrical conductors into the insulation-displacement contacts.

7. An electrical component as claimed in claim 1, wherein the second housing section has circular cavities extending inwardly from an outer surface thereof, bottom walls of the circular cavities have holes therethrough, the first contacts are annular receptacle contacts extending through the holes into the circular cavities.

8. An electrical component as claimed in claim 7, wherein the conductor-moving members comprise annular insulation-displacement modules that are positioned in the circular cavities and include a cylindrical housing having arcuate cavities parallel to a central hole, an insulation-displacement contact member having a pin contact extending outwardly from a metal disc having comma-shaped slots in alignment with the arcuate cavities, and a cap member rotatably mounted onto the cylindrical housing and having holes through which the insulated electrical conductors are inserted and extend through large sections of the comma-shaped slots and into the arcuate cavities, rotation of the cap member causes the insulated electrical conductors to be moved into small sections of the comma-shaped slots thereby electrically connecting the insulated electrical conductors to the insulation-displacement contact member.

9. An electrical component as claimed in claim 8, wherein the walls of the circular cavities have L-shaped slots and the cylindrical housings have a projection for movement along the L-shaped slots to latch the annular insulation-displacement modules in the circular cavities.

10. An electrical component as claimed in claim 1, wherein the second housing section has rectangular cavities extending inwardly from an outer surface thereof, the first contacts extends into the rectangular cavities.

11. An electrical component as claimed in claim 10, wherein the conductor-moving members comprise rectangular insulation-displacement modules that are positioned in the rectangular cavities and include a rectangular housing having end cavities along which the insulated electrical conductors extend, an insulation-displacement contact member having a blade contact disposed in a central cavity of the rectangular housing and slotted insulation-displacement contacts extending into the end cavities, cover members hingedly connected to the rectangular housing and movable to a closed position thereby pushing the insulated electrical conductors into the slotted insulation-displacement contacts.

12. An electrical component as claimed in claim 11, wherein latch members are provided on the cover members and the rectangular housing latching the cover members in the closed position.

13. An electrical component as claimed in claim 11, wherein the rectangular cavities have projections in opposing walls, and the cover members have recesses for matable engagement when the rectangular insulation-displacement modules are positioned within the rectangular cavities.

* * * * *